US009578946B2

(12) United States Patent
Huisinga et al.

(10) Patent No.: US 9,578,946 B2
(45) Date of Patent: Feb. 28, 2017

(54) TWEEZER HEAD FOR EPILATION

(75) Inventors: Matthias Huisinga, Weinheim (DE); Ralf Klug, Eschborn (DE); Judith Von Dahlen, Frankfurt am Main (DE); Michael Maichel, Frankfurt am Main (DE); Stefan Sindlinger, Dieburg (DE); Thomas Steiner, Trebur (DE)

(73) Assignee: Braun GmbH, Kronberg (DE)

( * ) Notice: Subject to any disclaimer, the term of this patent is extended or adjusted under 35 U.S.C. 154(b) by 916 days.

(21) Appl. No.: 13/315,736

(22) Filed: Dec. 9, 2011

(65) Prior Publication Data

US 2012/0165835 A1 Jun. 28, 2012

(30) Foreign Application Priority Data

Dec. 28, 2010 (EP) ..... 10016123

(51) Int. Cl.
*A61B 17/50* (2006.01)
*A45D 26/00* (2006.01)

(52) U.S. Cl.
CPC ..... *A45D 26/0028* (2013.01)

(58) Field of Classification Search
CPC ..... A45D 26/0028; A61B 17/00; A61B 17/50
USPC ..... 606/131, 133, 211; 425/71, 102
See application file for complete search history.

(56) References Cited

U.S. PATENT DOCUMENTS 5,041,123 A 8/1991 Oliveau et al.
2007/0212923 A1* 9/2007 Sanchez-Martinez et al. ..... 439/394
2008/0269780 A1 10/2008 Sanchez-Martinez et al.

FOREIGN PATENT DOCUMENTS

WO WO-2009/056923 A2 5/2009

OTHER PUBLICATIONS

U.S. Appl. No. 13/315,694, filed Dec. 9, 2011, Matthias Huisinga.
U.S. Appl. No. 13/315,714, filed Dec. 9, 2011, Matthias Huisinga.
International search report dated Jan. 30, 2012, 4 pages.
International search report dated Feb. 17, 2012, 4 pages.

* cited by examiner

*Primary Examiner* — Victor Nguyen
(74) *Attorney, Agent, or Firm* — Ronald Terk Sia; Kevin C. Johnson; Steven W. Miller

(57) ABSTRACT

The invention relates to an epilation head for an epilation device, in particular for plucking hair from human skin having a rotating cylinder and rotating around a rotational axis, the rotating cylinder having a number of plucking units for grasping and plucking out hair and having a skin oriented surface, wherein each plucking unit includes a movable clamping unit, a stationary clamping unit. The movable clamping unit and the stationary clamping unit form a closable plucking gap. The movable clamping units have a skin contacting surface and the total area of the skin contacting surfaces of the movable clamping units is greater than 5% of the area of the skin oriented surface.

9 Claims, 4 Drawing Sheets

TWEEZER HEAD FOR EPILATION

FIELD OF THE INVENTION

The invention relates to a motor-driven epilation head for an epilation device, in particular for plucking hairs of the human skin. The invention furthermore relates to an epilation device.

BACKGROUND OF THE INVENTION

Epilation devices serve for removing hairs, if possible including the roots thereof. Known epilation devices are designed in such a way, for example, that the hairs are clamped between adjacent clamping elements and plucked by means of a movement of the clamping elements relative to the skin. This typically requires that the clamping elements are closed in a predetermined position in each case in order to capture the hairs, moved into another predetermined position in a closed state together with the clamped hairs, and then reopened in order to release the plucked hairs. In order to implement this pattern of movement, the clamping elements may be arranged, for example, on a rotation cylinder that is set in rotation by means of an electric motor. The opening and closing of the clamping elements is controlled by means of a control mechanism that can be designed in various ways. Generally, the control mechanism has actuation elements that act on the clamping elements, such that the clamping elements are closed or opened.

A rotation cylinder of this type is known, for example, from EP 547 386 A. The rotation cylinder that is disclosed there for an epilation device is designed in such a way that movable clamping elements are coupled to actuation elements. The clamping elements can be moved toward one another in order to carry out a plucking movement. In the process, one clamping element in each case moves toward a central damping element from the left, and from the right.

Furthermore, an epilation device is known from EP 1 203 544 A1 in which the actuation elements are designed in the form of rods and arranged around the shaft, of the rotation cylinder. All of the rods are coupled to a single return spring in such a way that the clamping elements are pretensioned via the rods in the direction toward the opened state. In order to close the clamping elements, the rods are actuated in such a way that the clamping elements are displaced in an axial direction by overcoming the spring force of the return spring. These are displaced by the action of the return spring while in the non-actuated state of the rods and the clamping elements are opened as a result.

An embodiment of the invention equips an epilation device with a large number of clamping elements while keeping the expenditure of time and effort involved reasonable in order to attain as thorough and painless an epilation process as possible. In doing so, the epilation should be effective both on skin with thick hair growth and with sparse hair growth.

SUMMARY OF THE INVENTION

The invention relates to an epilation head for an epilation device, in particular for plucking hair from human skin having a rotating cylinder and rotating around a rotational axis, the rotating cylinder having a number of plucking units for grasping and plucking out hair and having a skin oriented surface, wherein each plucking unit comprises a movable clamping unit, a stationary clamping unit, wherein the movable clamping unit and the stationary clamping unit form a closable plucking gap and characterized in that the movable clamping units have a skin contacting surface and the total area of the skin contacting surfaces of the movable clamping units is greater than 5% of the area of the skin oriented surface.

The epilation head according to the invention for an epilation device, particularly for plucking hairs of the human skin, has a rotation cylinder capable, of rotating about a rotation axis. A multiplicity of plucking gaps is provided on the rotation cylinder for the purpose of plucking hairs. According to the present invention, a second closable plucking gap is found adjacent to a first closeable plucking gap. The first closeable plucking gap is determined by a first clamping element and by a second clamping element. These clamping elements are capable of moving towards one another, in order to thus close the plucking gap and optionally pluck at least one hair in the process. The second clamping element can form a second closeable plucking gap together with the third clamping element in a similar manner.

The invention provides a more skin friendly epilation roll. The particular mechanical set-up allows to design the skin contacting surface of the epilation roll more user friendly. According to the present invention, the moveable clamping units have a skin contacting surface. This is a surface which is brought in contact with the skin during regular operation of the epilation head. Each skin contacting surface of each clamping unit will have a given area. The total area of the skin contacting surfaces of the moveable clamping units can be obtained as the sum of the areas of the individual skin contacting surfaces.

The respective total area should be relatively large as compared to the area of the skin oriented surface of the rotation cylinder. The skin contacting surface of the rotation cylinder is essentially the bent surface of the cylinder (hence, the surfaces of the circular top and bottom areas of the cylinders are not to be added). Given the skin oriented surface of the epilation cylinders limited, it is important to make efficient use of it. Given that potentially any or almost any area of the skin oriented surface of the epilation head can be in contact with the skin, it is also important that the contact be skin friendly. It has been found in the context of the present invention, that a sufficiently high total area of the skin contacting surfaces of the moveable clamping units is useful, for example the respective total area can be greater than 2%, 5%, 10%, 15% or 20% of the area of the skin oriented surface.

Similar benefits are achieved in respect to having a sufficiently large total area of the skin contacting surfaces of the stationary clamping units, for example the respective total area can be greater than 2%, 5%, 10%, 15% or 20% of the area of the skin oriented surface.

Further benefits are achieved, if both total areas are, as compared to the prior art, relatively large and wherein the sum of the total area of the skin contacting surfaces of the movable clamping units and of the skin contacting surfaces of the movable clamping units (12) is greater than 2%. 5%, 10%, 15% or 20% of the area of the skin oriented surface.

In a further aspect, it is beneficial to have individual skin contacting surfaces which are larger than at least 1, or 2, or 5, or 10 $mm^2$ (but normally they should be less than 20 $mm^2$) in area.

Values for material for providing such clamping units having sufficiently large and skin friendly surfaces are plastic materials, such as polypropylene and polyethylene. Of course, not only the choice of the material but also the mechanical set-up as described further herein, is important.

It can be useful, that the first clamping element and the second clamping element are movably mounted. The first clamping element and the second clamping element should be capable of being jointly actuated by an actuation element. This serves for closing the first and the second plucking gap. For this purpose, the actuation element can, for example, exert pressure on the first clamping element, thereby moving it toward the second clamping element. This causes the first plucking gap to close. The actuation element can continue to move in such a way that also the second clamping element is moved toward the third clamping element, and also the second plucking gap is closed in this manner after the first plucking gap or simultaneously with the first plucking gap by means of the same actuation element in an essentially continuous movement.

According to the invention, the first and the second clamping element are to move into the same direction during the process of closing the first plucking gap and the second plucking gap. The movement of the first and second clamping element in the same direction has a multitude of advantages. For one thing, this sequence of movements makes it possible to design the rotation cylinder to be very compact. As a result, the rotation cylinder can have small overall dimensions, such that a compact epilation device can be provided. Moreover, several clamping elements and consequently several plucking gaps can be situated on a rotation cylinder of a given size.

Another aspect is the following: a plucking gap can generally be closed and reopened as often as desired, wherein the clamping elements during the opening process move in the opposite direction to that of the closing movement. This opening movement requires that the clamping elements can open into a sufficiently large space. When this space must be made available for an opening movement in two directions, the corresponding rotation cylinder cannot be as compact as with the opening movement according to the invention, or not as many plucking gaps can be provided on a rotation cylinder of a given size.

Furthermore, the combined movement of the first clamping element and the second clamping element in the same direction makes it possible to couple to one another the type of this movement, or in particular the effective clamping forces. When the first clamping element and the second clamping element are moved in the same direction by means of a common actuating element, the rotation cylinder can be designed in such a way that, a self-amplification of the clamping force is effected when hairs are threaded into several plucking gaps. If, for example, several hairs are threaded into the first plucking gap, the space between the first clamping element and the second clamping element only partially closes. This has the effect that, with a predetermined distance of movement of the actuation element, the second clamping element is pressed with increased pressure against the third clamping element. When epilating an area of skin with particularly thick hair growth, this has the effect that both plucking gaps exert a particularly high clamping force. In this manner hair from an area of skin with very thick hair growth is removed particularly efficiently. This also makes the device effective for areas of skin with particularly thick hair growth and allows a type of automatic adjustment of the arising plucking forces to the area of skin to be treated.

It is advantageous when the first clamping elements and the second clamping elements are designed as single components. For one thing, the clamping elements are rendered lightweight in this manner and are capable of moving toward one another rapidly with little inert mass. Furthermore, the described self-amplification of the clamping force can develop separately for different adjacent plucking gaps, independent from the remaining clamping elements.

It is also advantageous when the third clamping element is stationary. In this manner the third clamping element is capable of withstanding a high pressure that is exerted by the first clamping element and/or by the second clamping element. Furthermore, the described self-amplification effect of the clamping force then becomes dependent predominantly on the number of hairs in the first and the second plucking gap. Moreover, a device in which few parts are movable is mechanically simpler and therefore also more cost effective to produce.

Furthermore, it is advantageous when first spring elements for opening the first plucking gap are provided that act on the first clamping element and on the second clamping element independently from the actuation elements. Alternatively or additionally, second spring elements that act on the second clamping element and on the third element independently from the actuation elements are provided also for opening the second plucking gap. The spring elements in this context can advantageously be designed in the form of helical springs. Helical springs have a long serviceable life and provide an adequate spring force even in dynamic rapid cycles of motion.

The invention has the advantage that, by means of the selected arrangement of the first clamping elements, the available space can be very well utilized and, as a result, many pairs of first and second clamping elements can be situated in the epilation head according to the invention. A large number of clamping element pairs makes possible an almost continuous plucking of hairs, such that the epilation process as a whole is a relatively pain-free process. Because the spring elements act on the first clamping elements independently from the actuation elements, a large opening width can be achieved very rapidly. This, in turn, allows a very thorough epilation.

In the epilation head the rotation axis of the rotation cylinder can extend and in the context of the present invention preferably extends outside the first clamping elements. One advantage of this is that the first clamping elements that extend maximally to the rotation axis of the rotation cylinder are thus relatively small and therefore have a low mass. This has a positive effect on the dynamics of the movements thereof and makes possible an operation of the epilation head according to the invention with comparatively low noise generation.

The improved mechanics of the rotation cylinder, in particular also the self-amplifying effects of the clamping force, make it possible in the context of the present invention to produce some of the clamping elements or even all of the clamping elements from plastic.

The third clamping elements can be arranged rigidly in the rotation cylinder. As a result, the mechanics are simplified and only small overall dimensions are required. In particular, several second clamping elements are arranged on a common support in each case. It is particularly advantageous in this case when the second clamping elements are distributed axially offset from one another over the circumference of the supports. A continuous plucking region can be implemented in this manner, wherein the plucking process occurs in rapid succession. The actuation elements are preferably designed in the form of rods that strike the first clamping elements in an axial direction. Such rods can be produced very cost-effectively and allow very simple and robust mechanics for the actuation of the first, clamping elements.

The first and the second clamping elements can be made of metal, such that they can absorb high mechanical loads in spite of small dimensions and, due to the hardness thereof, can clamp the hairs reliably. However, the first and the second clamping elements are preferably made of plastic. In this manner a very cost-effective production is possible. Additionally, the weight of the epilation head according to the invention can be kept relatively low. An additional advantage lies in a noise and vibration damping during the striking of the first clamping elements. The invention additionally relates to an epilation device, in particular for plucking hairs of the human skin, comprising a handheld housing and the epilation head according to the invention.

BRIEF DESCRIPTION OF THE DRAWINGS

The invention will be explained in further detain by means of the exemplary embodiments shown in the drawings below, in which.

DETAILED DESCRIPTION OF THE INVENTION

Figure 1:
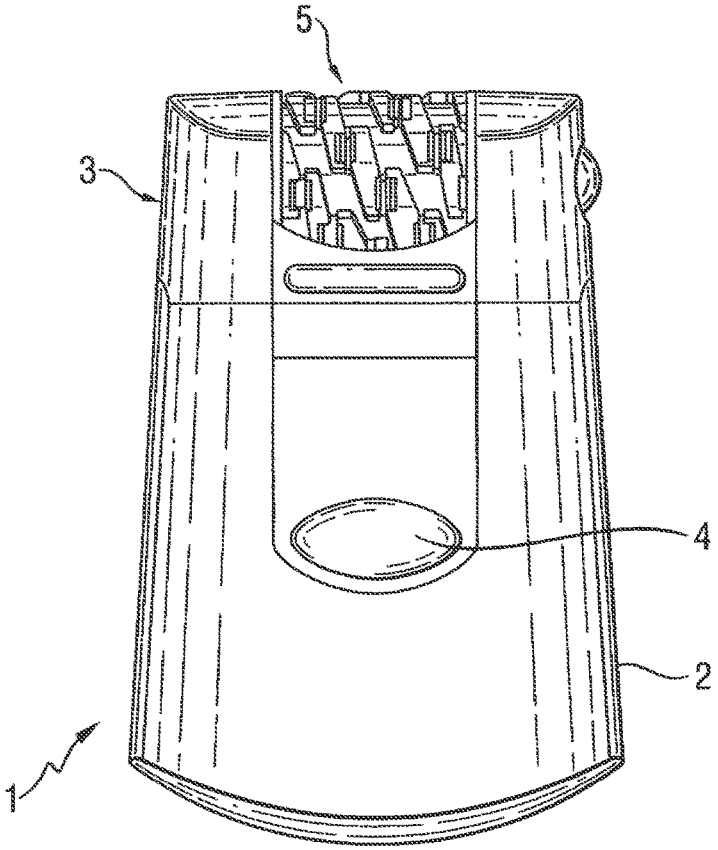
FIG. 1 shows a side view of an exemplary embodiment of a typical epilation device which, however, is not designed in detail according to the invention.

FIG. 1 shows a side view of an exemplary embodiment of an epilation device 1 typical of the generic type but not designed in detail according to the invention. The epilation device 1 has a housing 2. This housing wilt typically have a motor and a power adapter. Additionally it can also have gear units. Placed upon the housing 2 is the epilation head 3. A further main component of the device is the switch 4, which is placed centrally on the front of the housing. With this switch the rotation cylinder 5 can then be set in motion in order to perform an epilation process. The rotation cylinder 5 can have, for example on its outer side walls, gear wheels that can be connected via appropriate drive elements (possibly also via a gear unit) to the motor. The depicted rotation cylinder has a multiplicity of plucking units, each of which, however, only has one closeable plucking gap and only two clamping elements and which, therefore, are not designed according to the invention. The depicted rotation cylinder 5, however, could easily be replaced with a rotation cylinder according to the invention, since this rotation cylinder is compatible with a large number of conventional epilation devices and epilation heads.

Figure 2:
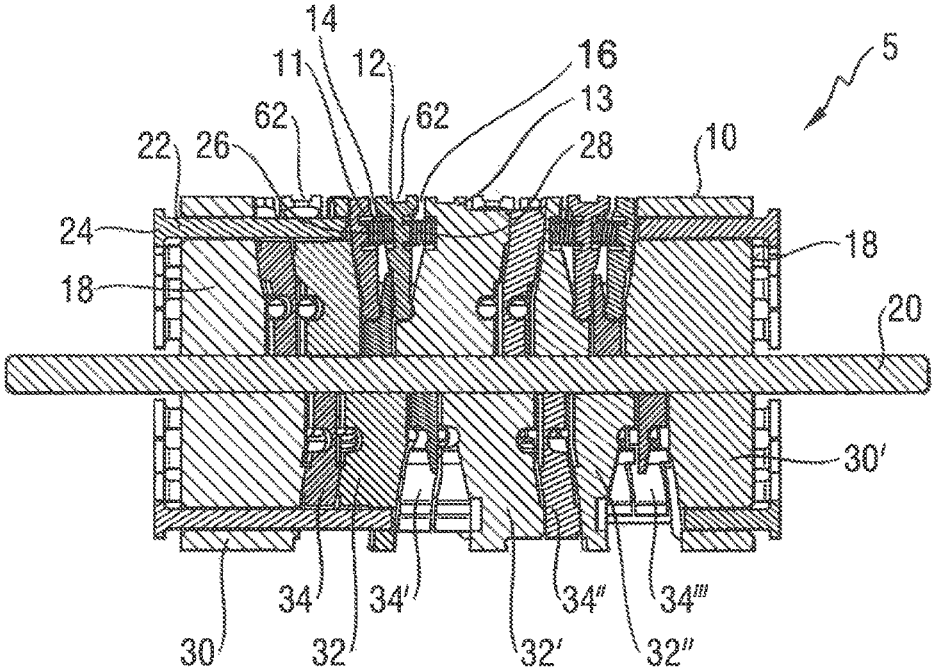
FIG. 2 shows a sectional view through a rotation cylinder according to the invention.

FIG. 2 shows a sectional view through a rotation cylinder 5 according to the invention. This rotation cylinder first of all has a peripheral surface 10. The first clamping element 11, the adjacent second clamping element 12 and the adjacent third clamping element 13 and specifically their outer surface are essentially flush with this peripheral surface 10. A first plucking gap 14 is provided between the first clamping element 11 and the second clamping element 12. A second plucking gap 16 is provided between the second clamping element 12 and the third clamping element 13. The three clamping elements together with the enclosed two plucking gaps form a plucking unit for capturing and plucking hairs. The rotation cylinder 5 has a multiplicity of such plucking units arranged thereon. All of them are essentially flush with the peripheral surface 10. They preferably can be and are arranged axially and/or radially offset.

The rotation cylinder 5 is bordered laterally by two lateral side faces 18. The rotation cylinder 5 surrounds a central axis 20. Push rods 22 laterally protrude through the side faces into the rotation cylinder 5. The push rods 22 have pusher heads 24, with which they can be actuated, i.e. pushed deeper into the rotation cylinder 5.

On pushing in the actuation elements in the form of the push rods 22, the clamping elements are moved toward one another, seen that the plucking gap closes. Springs carry out the opening of the plucking gaps and also the return movement of the push rods 22. The first plucking gap 14 can be reopened by means of a first spring element 26. The second plucking gap 16 can be reopened by means of a second spring element 28. The spring elements can be designed, for example, in the form of a first and a second helical spring.

In an advantageous embodiment the rotation cylinder 5 is composed of a plurality of discs being placed one upon the other. The rotation cylinder depicted in FIG. 2 can be assembled using an outer jaw 30. The outer jaw 30 functions like a stop disk. It provides an end stop for the movable clamping elements. In the context of the present invention, such an end stop can (optionally) be designed to further act as a third clamping element 13.

Supports in the form of guiding disks 34 are provided between the outer jaws and the stop disks. The geometry of the guiding disks permits the guiding and anchoring of clamping elements.

Figure 3:
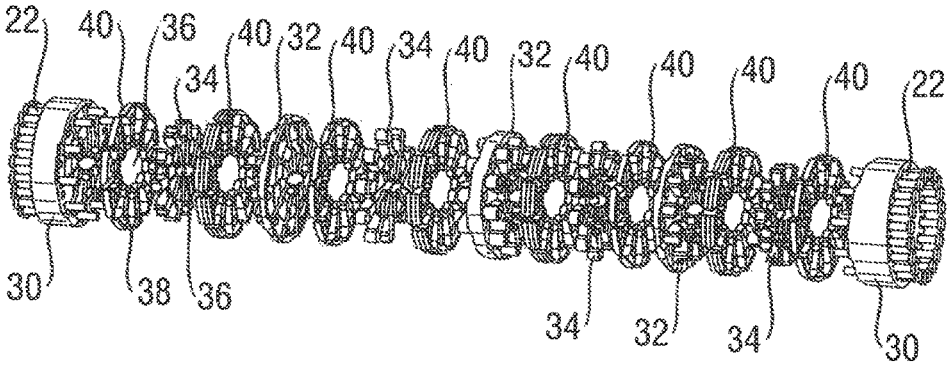
FIG. 3 shows an exploded view of the same rotation cylinder according to the invention.

The design of a rotation cylinder 5 according to the invention can be seen particularly well also in the exploded view of FIG. 3. Visible on the left is an outer jaw 30 that carries a multiplicity of push rods 22. Adjoining the outer jaw 30 is a first layer of clamping elements, a clamping element 40 of which is emphasized by way of example. The clamping elements also have pusher feed-throughs 38. The push rods 22 are led through these feed-throughs 38 and can exert force onto further inwardly situated clamping elements, without the clamping element that offers only one feed-through 38 being actuated by the push rods 22 as an actuation element. The ring of clamping elements 40 additionally is arranged in such a way that there is a rotation axis feed-through 36. Such a rotation axis feed-through is provided for all of the layers of the rotation cylinder. Adjoining the layer of clamping elements 40 is a guiding disk 34. Provided in this guiding disk 34, also in the center, is a rotation axis feed-through 36 (in the description of this exploded view, components that are identical or similar to one another are denoted with the same reference symbols). In contrast to the layer of clamping elements 40, the disk is a unitary piece. Adjacent to the disc are clamping elements. These clamping elements again form a layer, but are not connected. Further adjacent elements are: an additional stop disk 32, an additional layer of clamping elements 40, an additional guiding disk 34. etc., to the right outer jaw 30, which likewise has push rods 22.

Figure 4:
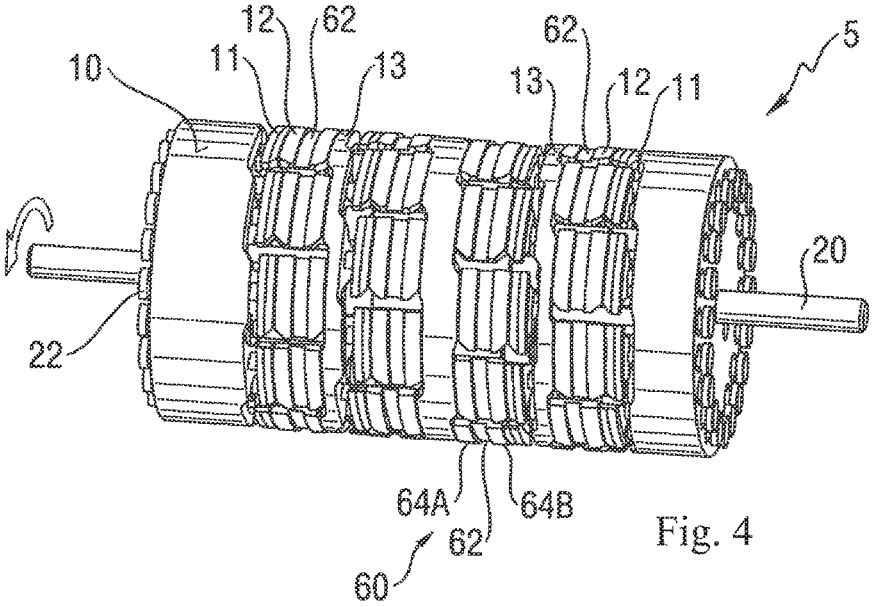
FIG. 4 shows a perspective view of the same rotation cylinder according to the invention.

FIG. 4 provides a perspective illustration of the same rotation cylinder 5 according to the invention. The view is of an essential portion of the peripheral surface of the rotation cylinder 5, Due to the advantageous construction of file rotation cylinder 5, this peripheral surface 10 is capable of accommodating a particularly large number of plucking units. The first clamping element 11, the second clamping element 12 and the third clamping element 13 of different clamping units are shown in each case by way of example. Components that are identical or similar to one another are denoted with the corresponding reference symbols in each case.

Figure 5:
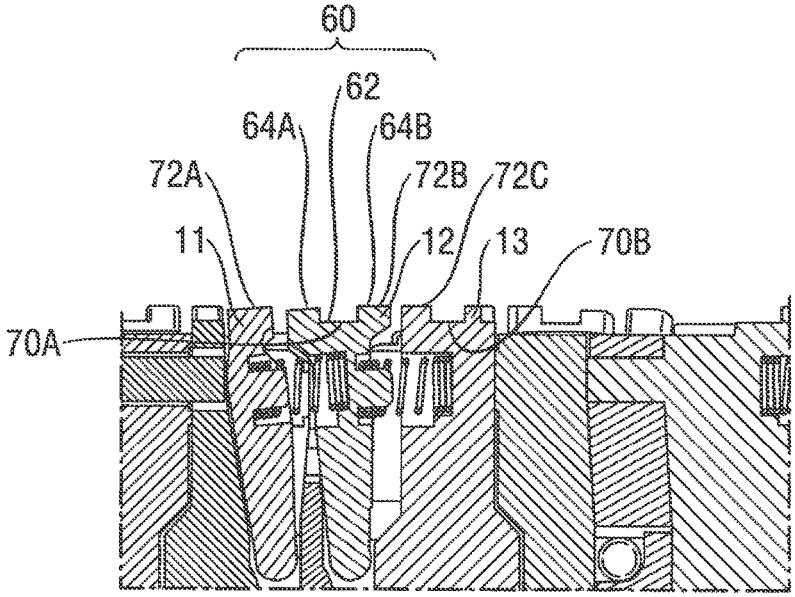
FIG. 5 shows an enlarged sectional view of clamping elements for a rotation cylinder.

FIG. 5 provides enlarged sectional view of clamping elements. As can be nicely seen again, a first plucking gap 14 is provided between the first clamping element 11 and the second clamping element 12. A second plucking gap 16 is provided between the second clamping element 12 and the third clamping element 13. The three clamping elements together with the enclosed two plucking gaps form a plucking unit for capturing and plucking hairs. Clamping elements 12 and 13 are combined with a hair guiding devices 60. Provided, that the clamping element has a sufficient area on its top, it is possible to have the hair guiding device 60 attached to the top of the moveable clamping elements. As shown for movable clamping element 12, a raised structure 64A is provided the left of the recess 62 and a raised structure 64B is provided to the right of the recess 62.

The bottom portions of the recess define a base level 70, which for example spans from the bottom portion 70A of recess 62 in clamping element 12 to the bottom portion 70B in clamping element 13. Elements above these base level from an elevation level. Generally, the average height of the elevations above the base level 70 defines an elevation level 72. In the situation depicted in FIG. 5 all elevations have essentially the same height over the base level, such that elevation level corresponds to the level of the outer surfaces of the raised structures of the clamping elements, and hence connects portions 72A, 72B, and 72C.

Figure 6:
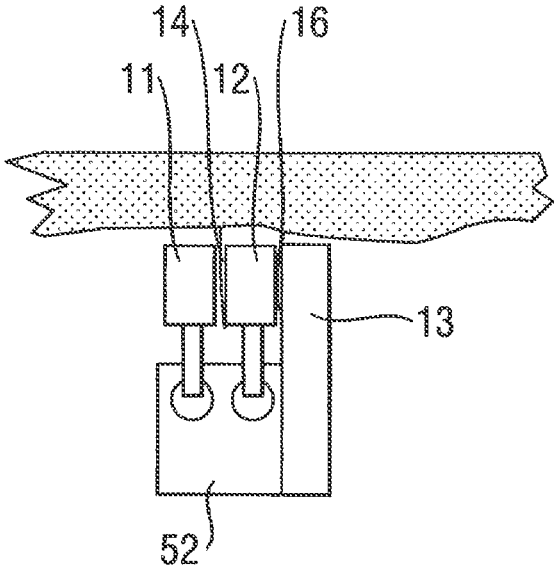
FIG. 6 shows a schematic diagram of the mode of operation of the clamping elements, which are shown with open plucking gaps.
Figure 7:
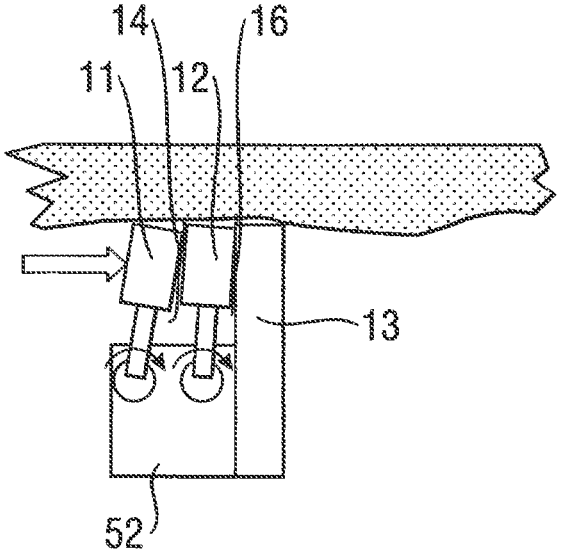
FIG. 7 shows a schematic diagram of the mode of operation of the clamping elements, which are shown with closed plucking gaps.

FIGS. 6 and 7 again schematically illustrate the mode of operation of the rotation cylinder 5. Portions of the rotation cylinder 5 are depicted in a simplified manner as a guide 52. Such a guide can be provided, for example, by means of the stop disks 32 in combination with adjacent guiding disks 34. However, other types of guides are also possible. The guide advantageously permits a displacement of the clamping elements 40 at least at the outer end thereof, that is, in the region of the clamping jaws 46 having the clamping surfaces 48. This movement can be in part a rotational movement (as shown) or also a lateral displacement. During the epilation process hairs can be fed into die first plucking gap 14 and into the second plucking gap 16. The movable first clamping element and the movable second clamping element 12 can be moved toward the stationary third clamping element by means of a force acting from one side. In the process, the first plucking gap 14 and the second, plucking gap 16 close. In this manner, clamping forces are built up by means of which hairs can then be plucked. To the extent that clamping forces are actuated by a predetermined motion amplitude of actuation elements, the force acting on the second plucking gap 16 increases with the number of hairs that are already located in the first plucking gap 14. This leads to an amplifying effect that makes the epilation particularly efficient.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. An epilation head for an epilation device particularly for plucking hair from human skin having a rotating cylinder and rotating around a rotational axis, the rotating cylinder having a number of plucking units for grasping and plucking out hair and having a skin oriented surface, wherein each plucking unit comprises a movable clamping unit, a stationary clamping unit, wherein the movable clamping unit and the stationary clamping unit form a closable plucking gap and wherein in that the movable clamping units have a skin contacting surface and the total area of the skin contacting surfaces of the movable clamping units is greater than about 5% of the area of the skin oriented surface.

2. The epilation head according to claim 1, wherein also the stationary units have a skin contacting surface and the total area of the skin contacting surfaces of the stationary units the is greater than about 5% of the area of the skin oriented surface.

3. The epilation head according to claim 2, wherein the movable clamping units have a skin contacting surface and have a total area of the skin contacting surfaces of the movable clamping units and the stationary units have a skin contacting surface and have a total area of the skin contacting surfaces of the stationary units and wherein the sum of the total area of the skin contacting surfaces of the movable clamping units and of the skin contacting surfaces of the movable clamping units is greater than about 10% of the area of the skin oriented surface.

4. The epilation head according to claim 1, wherein each movable clamping unit comprises a skin contacting surface of at least about 2 $mm^2$.

5. The epilation head according to claim 1, wherein each stationary clamping unit comprises a skin contacting surface of at least about 2 $mm^2$.

6. The epilation head according to claim 1, having an additional movable clamping unit, wherein the additional movable clamping unit forms an additional closable plucking gap with the movable clamping unit, and the additional movable clamping unit also comprises a skin contacting surface of at least about 2 $mm^2$.

7. The epilation head according to claim 6, in which the movable clamping unit and/or the additional movable clamping unit are arranged axially to each other along the support.

8. The epilation head according to claim 1, in which the clamping units are made of plastic.

9. An epilation device, in particular for plucking out hair from human skin, having a handheld housing and a motor-driven epilation head, wherein the epilation head is designed according to claim 1.

* * * * *